United States Patent [19]

Galloway et al.

[11] Patent Number: 4,773,157

[45] Date of Patent: Sep. 27, 1988

[54] METHOD OF MAKING AN ELECTRICAL TERMINATION

[75] Inventors: Michael D. Galloway; Dimitry Grabbe, both of Middletown; David T. Shaffer, Harrisburg, all of Pa.

[73] Assignee: AMP Incorporated, Harrisburg, Pa.

[21] Appl. No.: 857,209

[22] Filed: Apr. 29, 1986

[51] Int. Cl.[4] ..... H01R 4/10

[52] U.S. Cl. ..... 29/863; 29/623; 29/865; 174/84 R; 439/883

[58] Field of Search ..... 29/623, 863, 865; 339/276 R, 276 T; 337/186, 188, 190, 231, 252, 253, 260; 174/84 R, 84 C; 439/883

[56] References Cited

U.S. PATENT DOCUMENTS

| | | | |
|---|---|---|---|
| 1,605,688 | 11/1926 | Olin et al. | 29/623 |
| 2,535,013 | 12/1950 | Freedom | 339/276 T |
| 2,550,578 | 4/1951 | McBerty | 339/276 R |
| 2,572,956 | 10/1951 | Servis | 339/276 R |
| 2,721,314 | 10/1955 | Beers | 339/276 R |
| 3,038,958 | 6/1962 | Swengel . | |
| 3,777,051 | 12/1973 | Ziegler, Jr. et al. | 174/94 R |
| 3,878,318 | 4/1975 | Ziegler, Jr. et al. | 174/94 R |
| 4,173,388 | 11/1979 | Brandeau | 339/276 T |
| 4,228,584 | 10/1980 | Sherrod | 29/863 |
| 4,253,234 | 3/1981 | Niles et al. | 339/276 T |
| 4,254,448 | 3/1981 | Martyniak | 29/832 X |
| 4,365,396 | 12/1982 | Baba et al. | 29/854 |
| 4,563,666 | 1/1980 | Borzoni | 337/252 |

*Primary Examiner*—Howard N. Goldberg
*Assistant Examiner*—Taylor J. Ross
*Attorney, Agent, or Firm*—Anton P. Ness

[57] ABSTRACT

A wire length having a very small diameter is terminated to a contact member by forming a groove in the contact member, disposing the wire length entirely within and along the groove, and striking the surface of the contact on both sides of the groove deforming the sides of the groove downwardly and inwardly into the groove firmly against the wire therein. The contact members can be made in lead frames on a carrier strip and have grooves formed therein, the wire can be placed in the grooves and terminated to the contact members in an automated assembly to make, for example, fuse components where wire segments bridge gaps between associated contact sections of pairs of the contact members, and the lead frames can have housings molded thereto while on the carrier strip.

8 Claims, 5 Drawing Sheets

FIG. 6
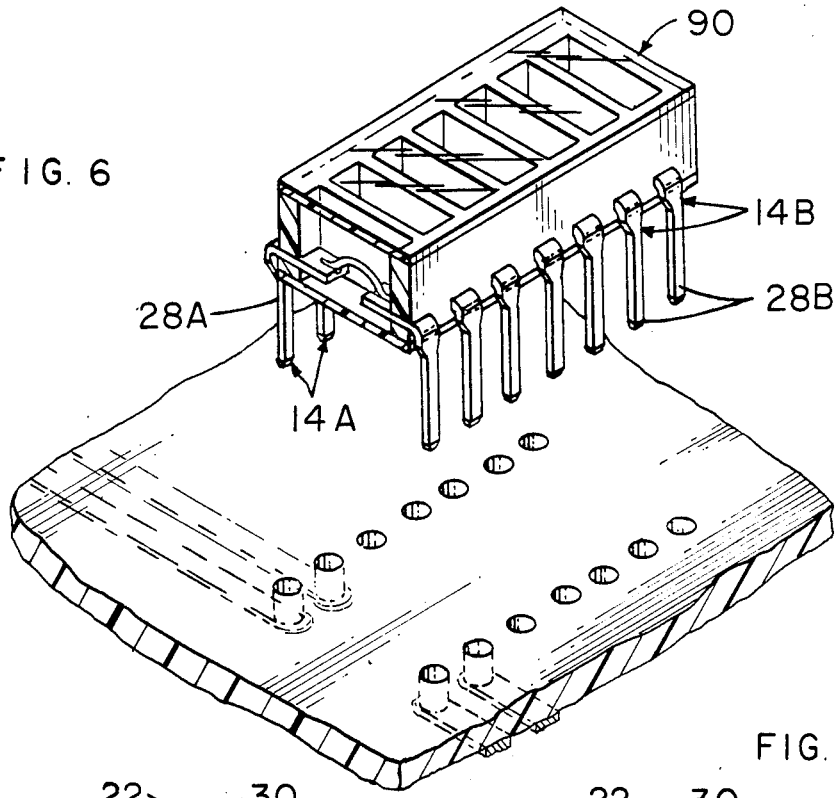
FIG. 4B
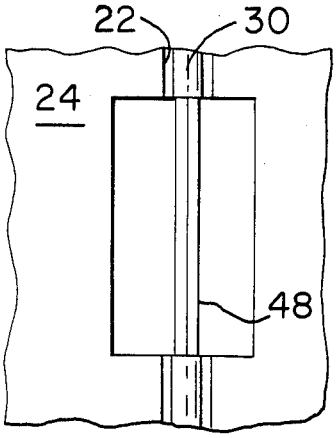
FIG. 4A
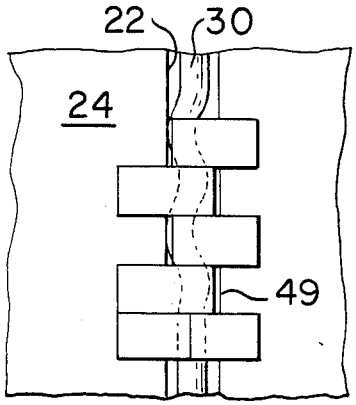
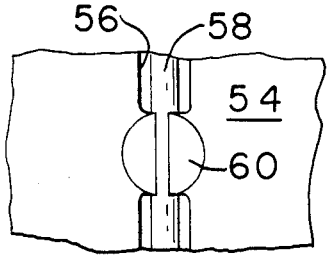
FIG. 4C

METHOD OF MAKING AN ELECTRICAL TERMINATION

FIELD OF THE INVENTION

The present invention relates to the field of electrical connections and more particularly to solderless wire termination.

BACKGROUND OF THE INVENTION

Known techniques of terminating conductor wire to a terminal include soldering, welding, wire-wrapping, insulation displacement and crimping. Such techniques do not work well with very small diameter wire, or are otherwise very expensive for mass production or automatic assembly.

U.S. Pat. Nos. 3,038,958, 3,777,051, and 3,878,318 disclose using an anvil to strike a relatively large diameter conductor wire (such as of aluminum) to tamp the wire into a groove of a terminal, the groove having a width about the same as the diameter of the wire but having an undercut below the terminal surface so that the wire is deformed outwardly into the undercut to fit the shape of the groove and be held therein. U.S. Pat. No. 4,173,388 also discloses deforming a wire into a groove of a contact plate to wedge it between the sides of the groove and then fusing the wire to the contact. All these references teach deforming the wire, which is not desirable with wire of very small diameter because it is likely to significantly effect the resistance characteristics of the wire or even cause breakage of the wire.

It is desirable to provide an assured termination of a wire having very small diameter such as 0.0015 inches or less, to a contact terminal without welding or soldering.

SUMMARY OF THE INVENTION

The present invention is a method of terminating a very small diameter wire to a surface of a terminal section having a thickness at least twice as great as the wire diameter. A groove is formed axially in one surface of the terminal section by skiving. The wire is placed axially within the groove and preferably below the plane of the top surface of the terminal section. A termination tool is applied to the terminal section across the groove deforming adjacent metal over the wire and tightly against the wire, securing the wire in place in the terminal in an assured electrical connection.

In another aspect of the method of the present invention, to form a fuse for a programmable shunt or a fuse component for a circuit panel, two ends of a wire segment are terminated to two opposing coplanar contact sections of a pair of contacts, forming a fuse element bridging the gap between the contact section. In still another aspect, a continuous automated assembly method economically provides for the stamping, skiving and small wire termination to a plurality of pairs of contacts on a carrier strip in one operation.

BRIEF DESCRIPTION OF THE DRAWINGS

FIGS. 4A to 4C show plan views of representative terminations.

FIG. 6 is an illustration of an electrical component utilizing the termination method of the present invention.

DETAILED DESCRIPTION OF THE PREFERRED EMBODIMENTS

Figure 1:
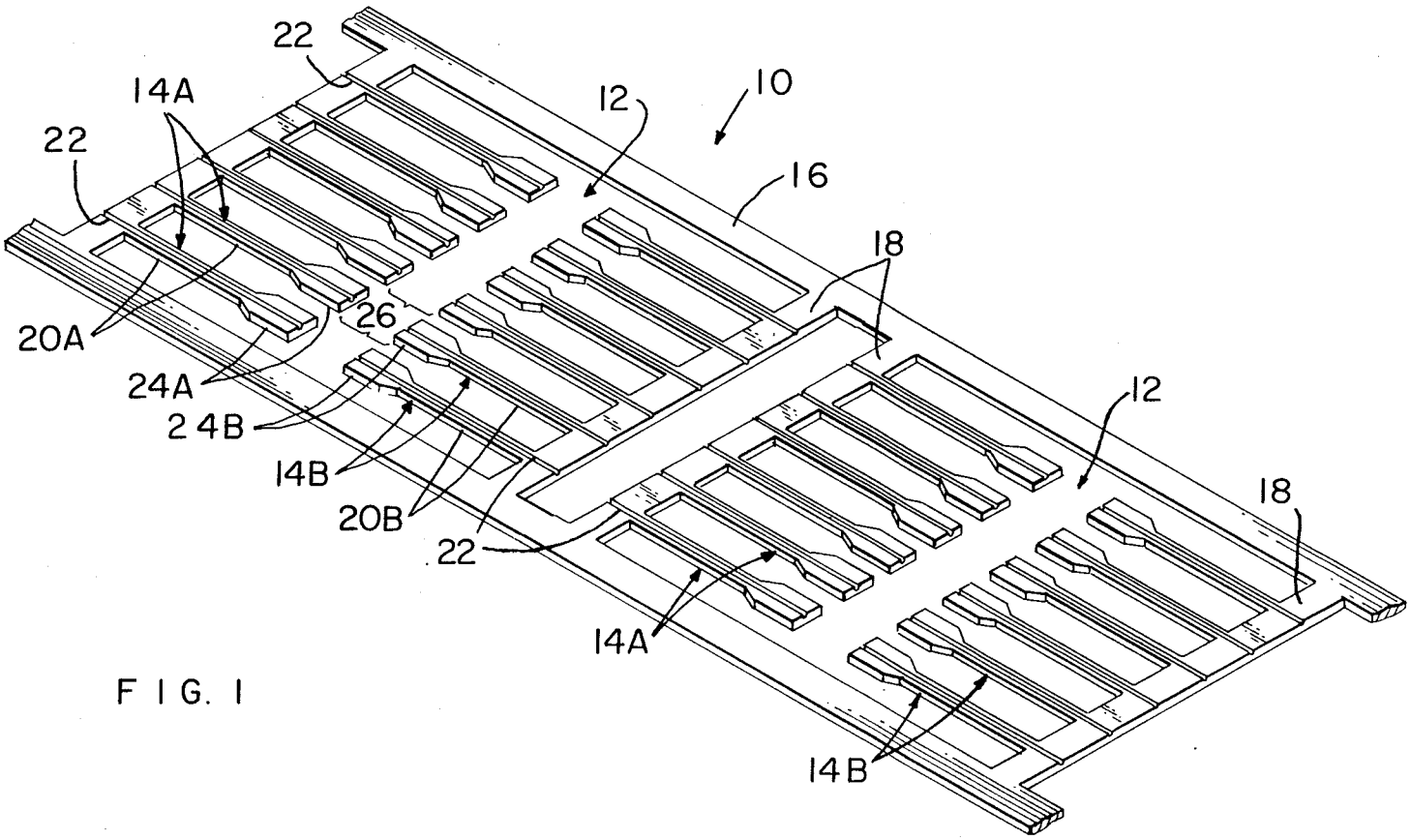
FIG. 1 is a perspective view of a carrier strip of lead frames for a fuse shunt or fuse component.

In FIG. 1, a carrier strip 10 has a plurality of lead frames 12 requiring termination to very small wire, and the contacts 14A,14B of each lead frame are disposed in opposing pairs between lateral carrier straps 16 and joined to transverse carrier straps 18 by leg sections 20A,20B. Along the axis of carrier strip 10 a groove 22 has been skived into each pair of contacts 14A,14B of lead frames 12. Preferably the skiving step has been performed prior to stamping the contacts 14A,14B into the blank metal strip, but it could also be done as the contact is being stamped. Each pair of contacts 14A,14B has a pair of proximate contact sections 24A,24B and each associated pair of contact sections 24A,24B has a spacing or gap 26 therebetween of selected dimension across which it is desired to extend a wire segment whose ends are to be terminated to respective ones of contact sections 24A,24B.

Figure 2A:
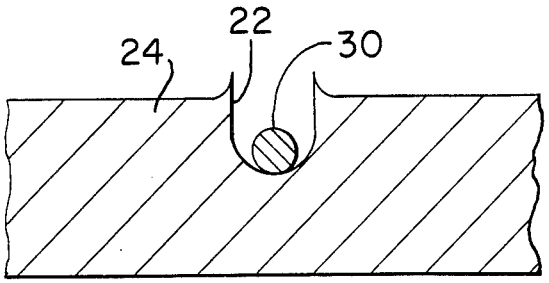
FIG. 2A is a cross-sectional view showing a wire disposed in the skived groove of a contact section.

FIG. 2A shows a wire 30 disposed in a groove 22 of a representative contact section 24. The wire 30 may be a continuous length (such as from a reel) along all the lead frames of the carrier strip, during manufacturing. A typical diameter of such wire 30 for which the present method is especially useful is 0.0015 inches, while the thickness of the contact section may be for example 0.0060 inches or more. Referring to FIG. 1, wire used for adjacent grooves can be of different diameters with correspondingly different groove dimensions.

Figure 2B:
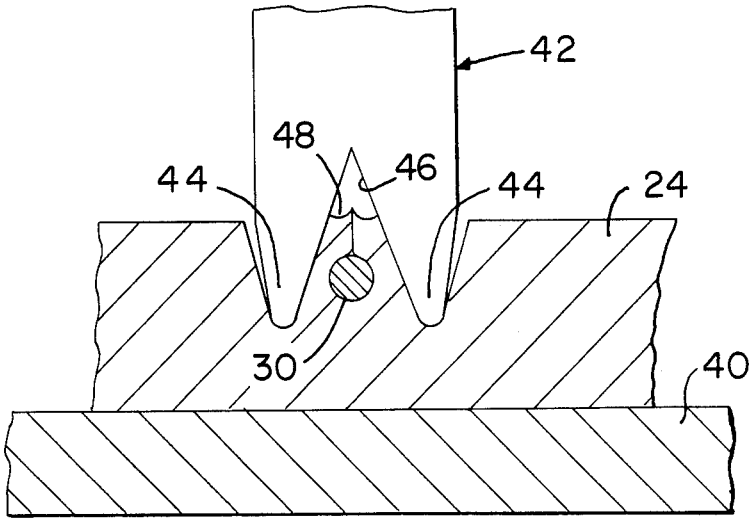
FIG. 2B is a cross-sectional view of the termination of the wire of FIG. 2A.

FIG. 2B shows contact section 24 placed on a support surface 40 while a termination tool 42 strikes the top surface of contact section 24 to terminate the wire at a selected location. Tool 42 has a bifurcated work end having relatively sharp-pointed tines 44 having a V-shaped terminating groove 46 therebetween which is oriented axially with respect to wire 30 and straddles wire groove 22. When tool 42 strikes under sufficient force, tines 44 strike contact section 24 on each side of wire groove 22 penetrating into the surface and deform portions of the contact section between the tines and adjacent to groove 22, inwardly into wire groove 22 and downwardly firmly against wire 30, forming the termination 48 which results in electrical connection between wire 30 and contact section 24 as well as a mechanical joint.

Figure 3A:
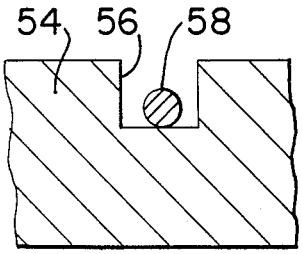
FIGS. 3A and 3B are similar to FIGS. 2A and 2B showing an alternate method of termination.
Figure 3B:
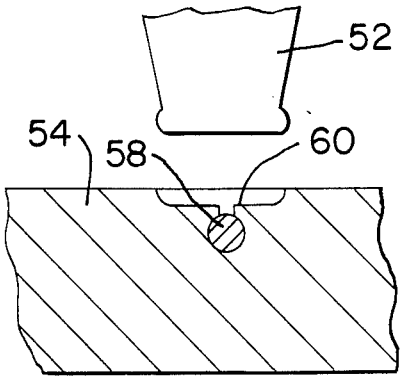

FIGS. 3A and 3B illustrate an alternate method of performing the termination using a flat-ended or blunt terminating tool 52 which strikes contact section 54 on both sides of groove 56 to deform portions thereof downwardly into groove 56 and inwardly and against wire 58, forming the termination 60.

The work end of tool 42 may preferably be generally rectangular or round leaving an impression at the site of termination 48 as shown in FIG. 4A. The work end of an alternative tool could comprise in addition to a pair of axially short symmetric tines, a series of three or four or more axially short asymmetric tines which are adjacent but staggered to terminate a wire 30 along a tortuous path, as represented in termination 49 of FIG. 4B for strain relief especially from temperature fluctuations in consideration of different rates of thermal expansion of the wire and the contact. Blunt ended tool 52 may preferably be circular, leaving a circular impression at the site of termination 60, as shown in FIG. 4C.

Figure 5A:
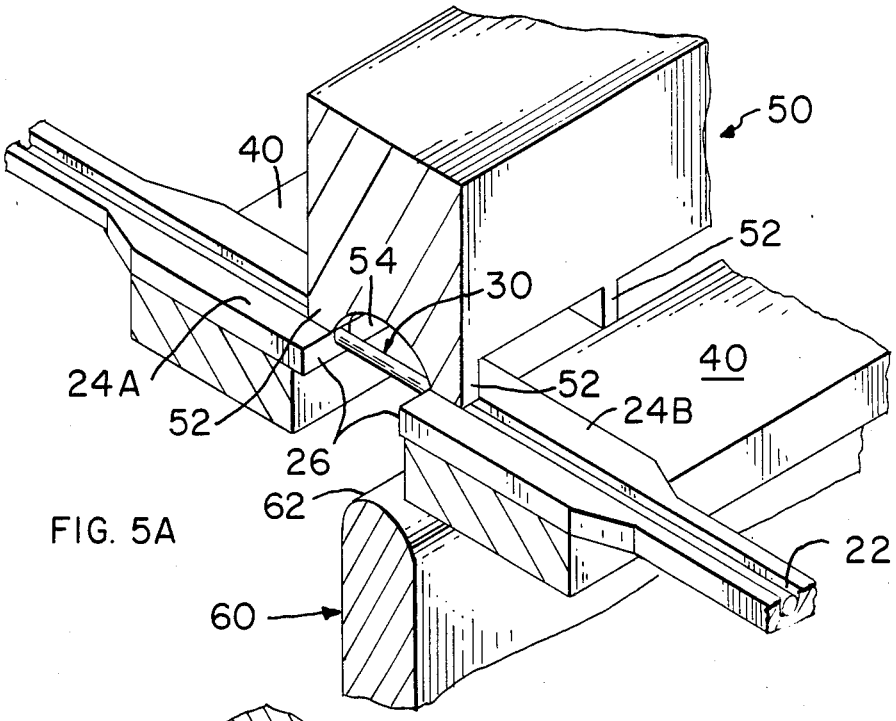
FIGS. 5A to 5D are perspective views showing the termination of a wire fuse in a pair of contacts of a lead frame of FIG. 1, including bowing the wire upward.

FIGS. 5A to 5D illustrate an automated process for performing the terminations of fine wire 30 to pairs of contacts 14A,14B of lead frames 12 shown in FIG. 1. In FIG. 5A a representative pair of contact sections 24A,24B has had a wire groove 22 formed therealong as shown in FIG. 1 and a continuous wire 30 disposed therein, bridging gap 26 therebetween. Contact sections 24A,24B are placed on respective spaced supports 40. A hold-down tool 50 is brought down atop contact sections 24A,24B. Tool 50 has a pair of wire hold-down projections 52 which enter wire groove 22 on each side of gap 26 and engage wire 30 to hold it firmly against the bottom of the groove during termination. A hold-down tool could also comprise hold down projections having elastomeric ends which deform when compressed against the wire in the groove and against the contact sections, holding the wire by compressive force.

Figure 5B:
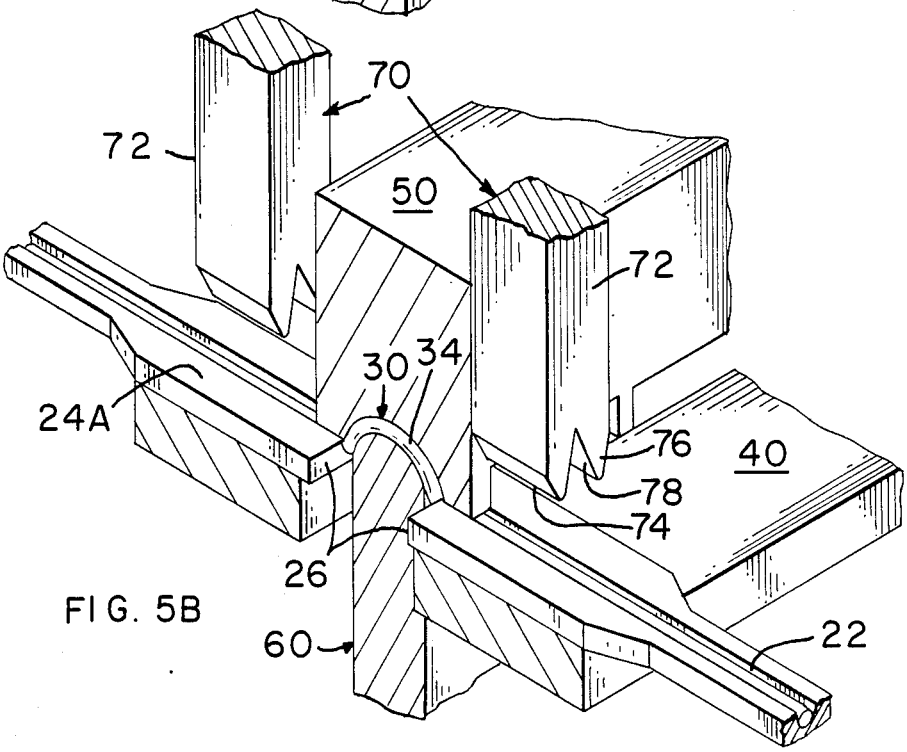

Because the particular example of product using the termination method of the present invention is a fuse component, it is desired to provide a fine wire fuse element bridging the pair of contact sections 24A,24B. It is preferable that such fuse element be arcuate away from the plane of the contact sections to minimize the later dissipation of heat by the contact mass for better performance of wire 30 as a fuse. Therefore, in the present example of termination assembly, a shaping tool 60 is shown in FIG. 5A which has a convex top edge 62 which will be brought upward into gap 26 and engage wire 30 as shown in FIG. 5B forming the wire into an upward arc 34 over gap 26. Hold-down tool 50 has a corresponding convex surface 54 extending between hold-down projections 52, against which wire 30 will be formed by shaping tool 60 while hold-down projections 52 firmly hold wire 30 against contact sections 24A,24B on each side of gap 26.

Figure 5C:
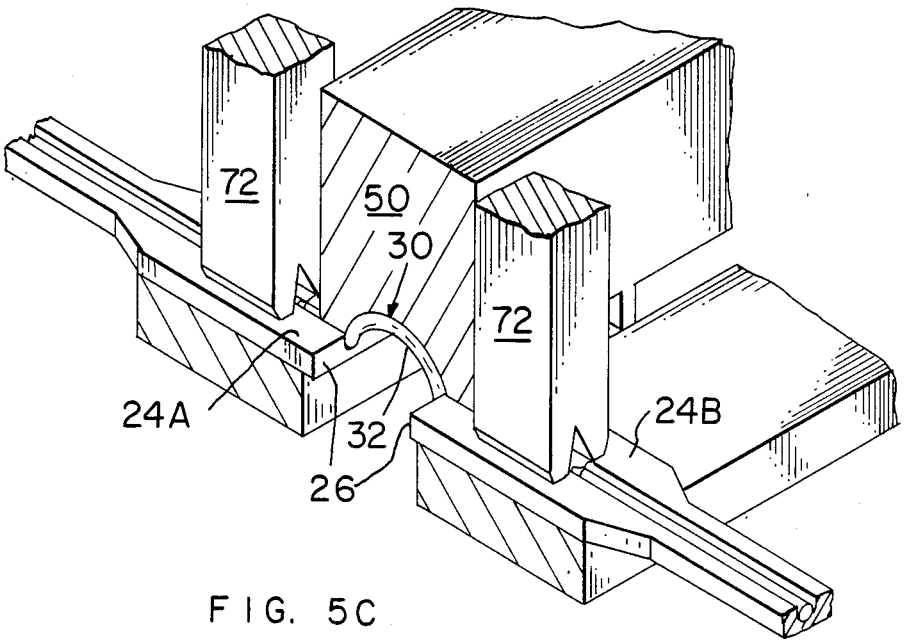
Figure 5D:
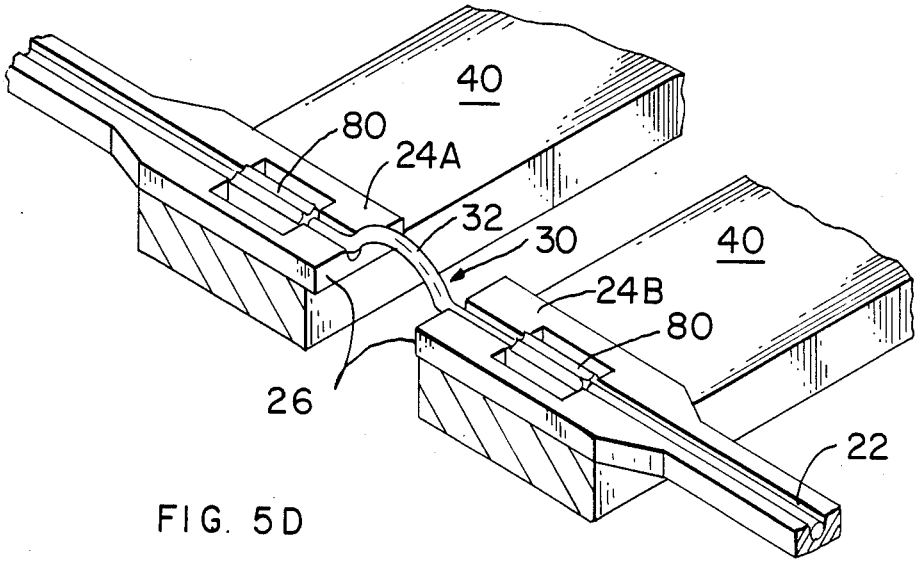

With wire 30 still being held down by hold-down tool 50, termination tooling 70 has portions 72 which are brought down on each side of hold-down tool 50 to terminate wire 30 to both contact sections 24A,24B proximate gap 26 and arc 34. Shown in FIGS. 5B and 5C the embodiment of each portion 72 corresponds to tool 42 of FIG. 2B and comprises a bifurcated work end 74 having a pair of relatively sharp-pointed tines 76 having a V-shaped terminating groove 78 therebetween. Each tooling portion 72 on each side of hold-down tool 50 has its respective V-shaped groove 78 oriented axially with respect to wire 30 and straddling wire groove 22. When portions 72 are struck against contact sections 24A,24B on each side of respective grooves 22 under sufficient controlled force, as illustrated in FIG. 5C, the sides of groove 22 will be deformed by tines 76 over and against wire 30 to form terminations 80 as shown in FIG. 5D.

Following the termination steps, other steps occur in the completion of the electrical component, such as severing the wire between the lead frames, molding or affixing a housing around each lead frame, sealing the cavity in which the fused contact sections are disposed, severing the lead frames from the carrier strip, and forming the portions of the contact members 14A,14B extending outwardly from the housing into outer contact sections 28A,28B as shown in FIG. 6. Electrical component 90 shown therein is a fuse component as disclosed in particular in U.S. patent application Ser. No. 857,212 filed Apr. 29, 1986, now U.S. Pat. No. 4,689,597, or a fuse shunt disclosed in U.S. patent application Ser. No. 857,204 filed Apr. 29, 1986, now U.S. Pat. No. 4,680,568. The tooling used in the various steps of FIGS. 5A to 5D preferably extend across the lead frames to act on each pair of contact sections 24A,24B of lead frame 12 simultaneously.

Other applications of the termination method of the present invention may occur in addition to use for the particular fuse components and fuse shunts described herein. Variations may occur to the particular steps of the termination process disclosed herein which are adapted to details of the other components with which it is desired to use the termination method of the present invention, and such variations would be within the spirit of the invention and the scope of the claims.

What is claimed is:

1. A method of terminating wire having a very small diameter to a thin plate-like contact member for electrical connection thereto, comprising the steps of:

selecting a length of very small diameter wire to be terminated;

selecting a planar surface portion of a major side of a plate-like contact member as a termination site;

forming a groove along said surface portion at least through said termination site having a depth and width larger than the diameter of said wire to be terminated to said contact member;

disposing a portion of said length of selected wire along a bottom of said groove at said termination site; and striking with tool means said surface portion of said contact member at said termination site along an axis perpendicular thereto adjacent said groove on both sides of said wire portion, thereby deforming sides of said groove downwardly and inwardly into said groove firmly against said wire portion.

2. A method as set forth in claim 1 wherein the work end of said tool means comprises at least one pair of sharp-pointed tines having a V-shaped groove therebetween, said work end of said tool means is oriented with said V-shaped groove axially aligned with and centered on said groove of said contact surface portion, and said tines enter into said surface portion of said contact member during said striking and deform said groove sides into said groove against said wire portion.

3. A method as set forth in claim 1 wherein the work end of said tool means is blunt and wider than the width of said groove of said contact portion, and said blunt work end forms a depression in said contact surface portion extending across said groove therein during said striking and deforms said groove sides into said groove against said wire portion.

4. A method of terminating a fuse element to a pair of contact members, said fuse element comprising a length of wire having a very small diameter, comprising the steps of:

selecting a length of very small diameter wire to be terminated;

selecting a pair of contact members having proximate contact sections with substantially planar surface portions substantially disposed in a common plane, and said contact sections spaced apart by a gap of selected dimension, said pair of contact members being secured in said spatial relationship;

forming a groove across surface portions of both said contact sections, the portions of said groove in both said contact sections being aligned and said groove being wider and deeper than the diameter of said wire;

disposing said length of wire in said groove in both said contact sections and extending across said gap;

holding said wire length firmly against the bottom of said groove; and striking with tool means said surface portions of said contact members along an axis perpendicular thereto adjacent said groove portions on both sides of said wire length thereby deforming sides of said groove portions downwardly and inwardly into said groove portions firmly against said wire length, terminating said wire length to said contact members.

5. A method as set forth in claim 4 further comprising the step, after said holding step, of forming the portion of said wire length extending across said gap into an arc extending away from the plane of said contact sections.

6. A method as set forth in claim 4 further comprising after said terminating, the step of severing said length of wire remote from said gap and said terminations.

7. A method as set forth in claim 4 wherein said pair of contact members are in lead frame form connected to a carrier strip, and further comprising after said terminating the step of severing said contact members from said lead frame and said carrier strip.

8. A method of preparing contact members for termination to wire length means disposed in grooves thereof, comprising the steps of:

selecting a continuous strip of metal having opposed planar major side surfaces;

forming at least one groove axially along a selected said planar surface of said strip of metal, said at least one groove having a width and depth greater than the wire diameter; and stamping said contact members in lead frame form connected to strap means forming a continuous carrier strip of said lead frames, at least one of said contact members containing a portion of said at least one groove

* * * * *